United States Patent [19]

Mair

[11] Patent Number: 5,016,058

[45] Date of Patent: May 14, 1991

[54] METHOD AND ARRANGEMENT FOR FIXING TONER IMAGES APPLIED TO A WEB-SHAPED RECORDING MEDIUM WITH HIGH QUALITY CONSISTENCY

[75] Inventor: Eduard Mair, Munich, Fed. Rep. of Germany

[73] Assignee: Siemens Aktiengesellschaft, Berlin and Munich, Fed. Rep. of Germany

[21] Appl. No.: 343,300

[22] PCT Filed: Oct. 19, 1987

[86] PCT No.: PCT/DE87/00468

§ 371 Date: Apr. 14, 1989

§ 102(e) Date: Apr. 14, 1989

[87] PCT Pub. No.: WO88/03281

PCT Pub. Date: May 5, 1988

[30] Foreign Application Priority Data

Oct. 24, 1986 [DE] Fed. Rep. of Germany ..... 3636324

[51] Int. Cl.[5] ..... G03G 15/20

[52] U.S. Cl. ..... 355/292; 354/321; 354/322; 355/282

[58] Field of Search ..... 354/300, 322, 321; 355/292, 282; 432/59

[56] References Cited

U.S. PATENT DOCUMENTS

| | | | |
|---|---|---|---|
| 2,048,182 | 7/1936 | Ybarrondo | 354/322 X |
| 3,010,375 | 11/1961 | Larsson | 354/322 X |
| 3,131,621 | 5/1964 | Murray | 354/322 |
| 3,264,970 | 8/1966 | Hersh et al. | 354/321 |
| 4,248;516 | 2/1981 | Groofers | 354/321 |
| 4,264,304 | 4/1981 | Hausmann . | |
| 4,424,702 | 1/1984 | Schoenewolf . | |
| 4,593,480 | 6/1986 | Mair et al. . | |

FOREIGN PATENT DOCUMENTS

| | | | |
|---|---|---|---|
| 609621 | 11/1960 | Canada | 355/292 |
| 0115866 | 8/1984 | European Pat. Off. . | |
| 1106780 | 5/1961 | Fed. Rep. of Germany . | |
| 2743369 | 4/1979 | Fed. Rep. of Germany . | |

*Primary Examiner*—A. T. Grimley
*Assistant Examiner*—T. A. Dang

[57] ABSTRACT

In a fixing station operating according to the principle of cold fixing in an electrophotographic printer means, a control of the influencing time of the solvent vapor on the recording medium ensues in addition to the control of the vapor concentration. To this end, the recording medium is immersed to different depths into a container containing a solvent vapor, being immersed thereinto via a deflection roller dependent on the operating conditions.

8 Claims, 3 Drawing Sheets

Figure 1:
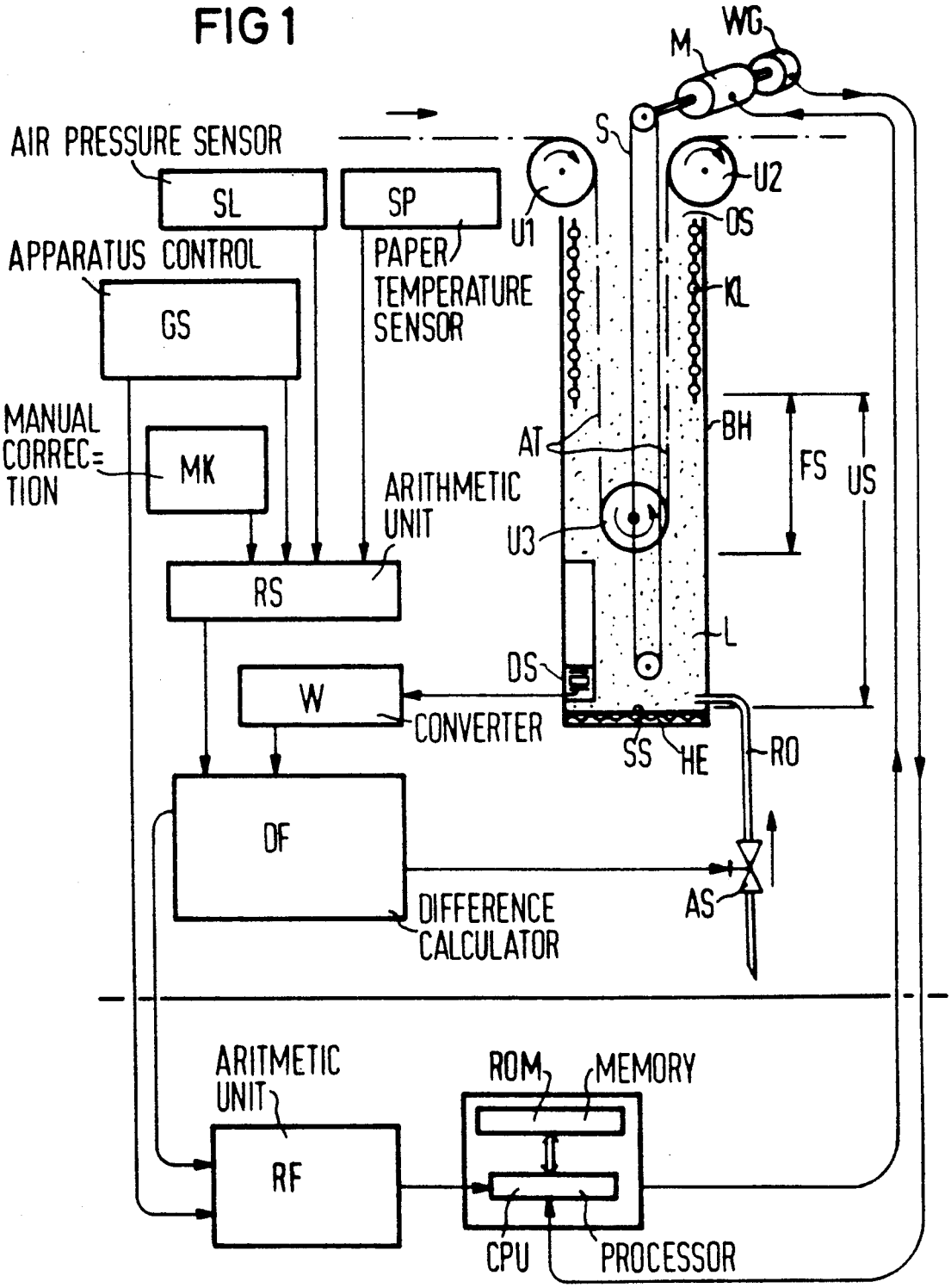

METHOD AND ARRANGEMENT FOR FIXING TONER IMAGES APPLIED TO A WEB-SHAPED RECORDING MEDIUM WITH HIGH QUALITY CONSISTENCY

The invention is directed to a method for fixing toner images applied to a web-shaped recording medium and to an arrangement for the implementation of the method according to the preamble of patent claims 1 and 2.

German Patent 28 38 864 discloses an apparatus of the species initially cited. For fixing toner powder applied to a recording medium, for example a paper web, in electrostatic copier or recording devices, the recording medium is transported through a fixing station in which the toner is joined fast to the recording medium. The fixing station contains a container through which the recording medium is conducted loop-shaped. Solvent vapor is generated at the underside of the container. A deflection means around which the recording medium is conducted is arranged in the region of the container enriched with solvent vapor. The recording medium is thereby exposed to the solvent vapor. After fixing, the recording medium departs the fixing region and is in turn conducted out of the container via an upper deflecting roller. The fixing region is limited in that cooling coils are arranged in the container wall in the upper region of the container. A cooled region in which solvent vapor emerging from the fixing region condenses thereby arises in the container. The lower deflection means can be removed from the container for introducing the recording medium.

Such non-mechanical copier or printer devices operating on the cold-fixing method are based on the principle that toner can be dissolved or, respectively, volatilized under the influence of solvent vapor and, thus, can penetrate into the surface of the recording medium. The degree of softening or, respectively, volatilization of the toner material depends critically on the concentration of the solvent vapor and on its influencing time.

The recording medium is thereby drawn through the vapor region of the fixing means with constant speed in the form of a loop. The reaction time between toner and solvent thus becomes a constant quantity in system-conditioned fashion.

In order to achieve the goal of a uniform fixing quality, the concentration of the solvent or, respectively, fixant vapor must be exactly held to a corresponding value.

To this end, German Patent 31 11 970 discloses a circuit arrangement in a means for monitoring the concentration of an air-vapor mixture in a toner image fixing station working with solvent vapor.

Fluctuations in the fixing strength, as may nonetheless still occur, can no longer be eliminated even by an improvement of the control outlay for the vapor concentration. The reason lies therein that the solvent (fixing means) is replenished in liquid form when the rated concentration is fallen below and must then be evaporated. The evaporation speed therefore led to a thermically conditioned dead time for the control system. A further dead time arises given an excess of vapor, i.e. an excessively high concentration of the solvent vapor. This is dismantled essentially only as a consequence of condensation at a cold trap arranged in the container for the solvent vapor and cannot be influenced in control-oriented terms.

The fixing strength decreases given a decrease in the vapor concentration. Given an increasing concentration, the toner dissolves to a more intense degree. The time span that elapses from the emergence of the recording medium from the fixing station up to deposit on a fanfold deck is available for the subsequent drying process.

When printed paper is deposited in the form of a fanfold deck without an adequate quantity of solvent vapor having dried, this leads thereto that the tonered (inked) regions of the paper web stick to one another. This particularly occurs when the deck part stacked thereabove compresses the region that lies lower. The residue of solvent that is still effective in this case allows the toner adhering to the paper web to harden only gradually. The more or less pasty consistency of the toner harbors the risk that the toner layers touching one another will fuse to one another. This must be avoided under all circumstances since fragments of the informational content of the recording medium would otherwise be destroyed when the stacked sheets that have glued together are folded open later.

In known fixing stations, the rated concentration is selected somewhat above the optimum vapor concentration of solvent in order to reliably suppress an inadequate (weak) fixing under all operating conditions. The disadvantage that printed pages will stick together at the operating temperatures close to the upper limit of the device specification or even given intermittent printing operation with brief printing and pausing phases is thereby consciously accepted.

It is an object of the invention to fashion an apparatus and a method of the species initially cited such that an optimum fixing quality is achieved under all operating conditions, regardless of fluctuations of the solvent concentration in the fixing station.

In a method of the species initially cited, this object is achieved in that a control of the influencing time of the solvent vapor on the recording medium is carried out by adjusting the passage distance of the recording medium through the solvent vapor container in order to achieve a uniform fixing quality given fluctuating operating conditions (inking degree, air pressure, paper temperature).

As a consequence of the inertia in producing the solvent vapor, the concentration of solvent vapor changes relatively slowly and does not always adapt to the changing conditions with adequate rapidity. This problem is intensified given high printing speeds as are typical for non-mechanical fast printers that operate according to the principle of electrophotography. In that the influencing time of the solvent vapor on the recording medium is controlled via the passage distance, a fast and unproblematical possibility of being able to quickly compensate fluctuations in the solvent vapor concentration derives.

In an advantageous arrangement for the implementation of the method of the invention, the guide means are arranged displaceable in position inside the container via an electromotive means for adjusting the influencing time of the solvent vapor on the recording medium such that a modification of the position of the guide means effects a modification of the passage distance of the recording medium through the container.

The container for the acceptance of the solvent vapor that is open at one side in a known fashion comprises deflection mechanisms for the recording medium at its upper side and in its floor region. The lower deflection mechanism is thereby arranged movable parallel to the long sides of the container inside the same container, being movable via the electromotive means.

Figure 2:
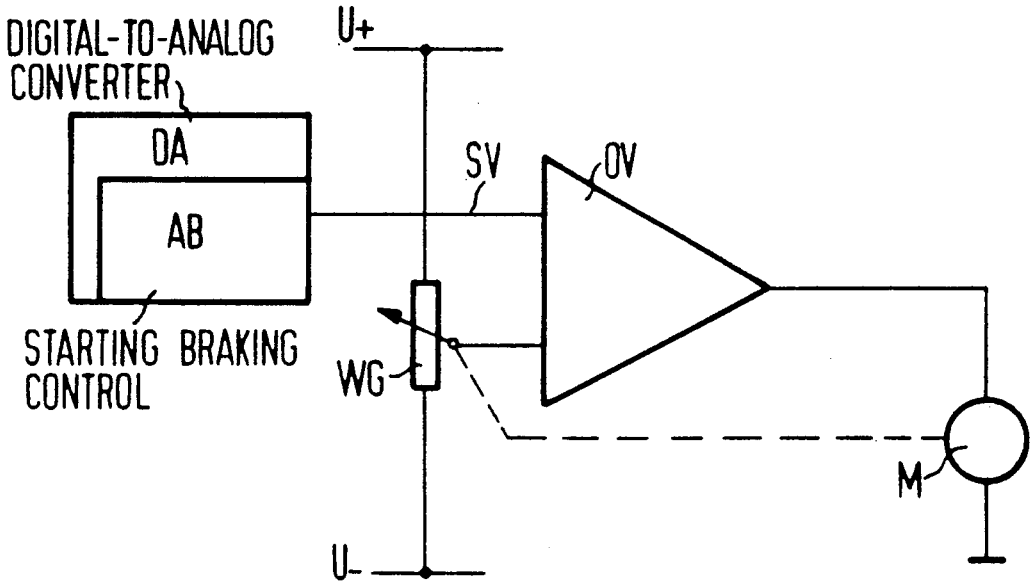
Figure 3:
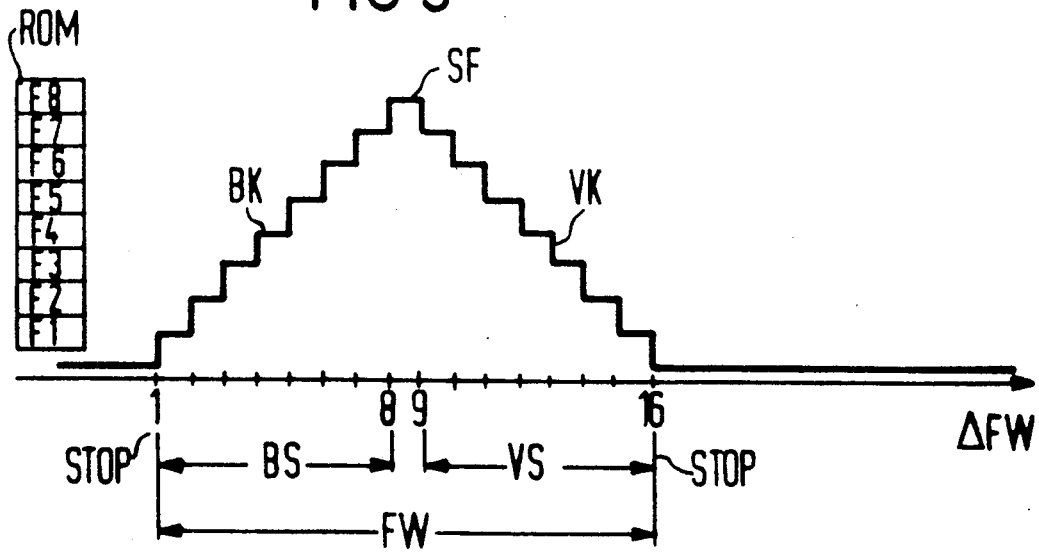
Figure 4:
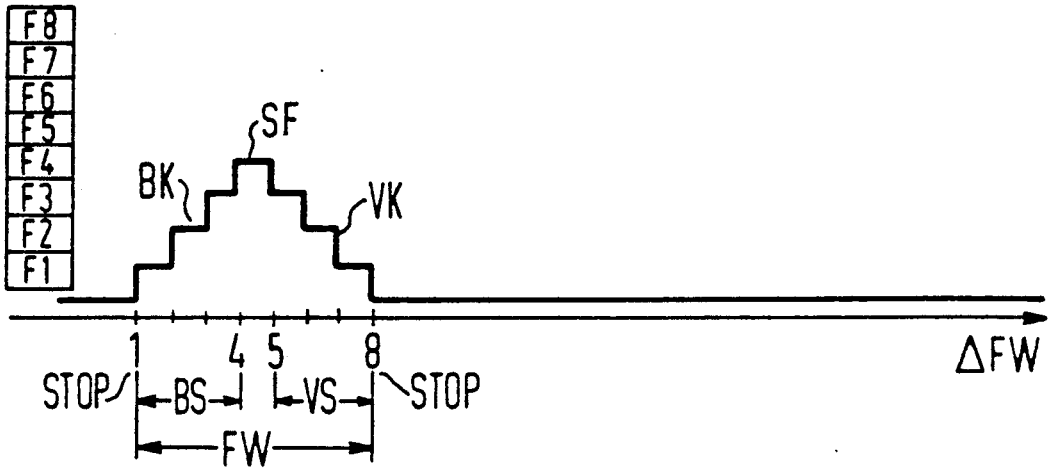
Figure 5:
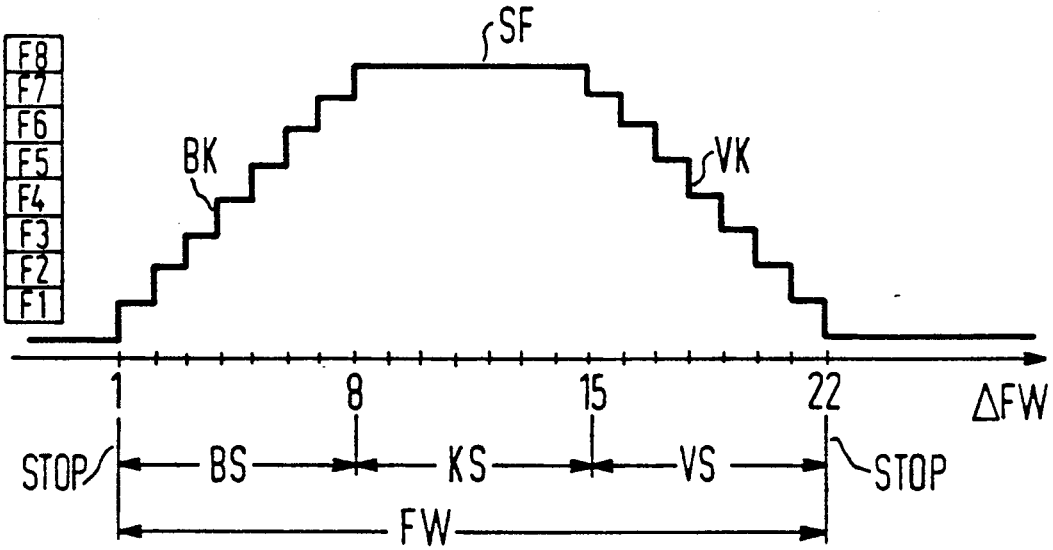

An embodiment of the invention is shown in the drawings and shall be set forth in greater detail below by way of example. Shown are:

FIG. 1 a schematic block illustration of an arrangement for fixing toner images in a printer means operating according to the principle of electrophotography;

FIG. 2 a schematic illustration of a servo drive employed in the arrangement;

FIGS. 3 through 5 various acceleration and retardation curves given different lanes of the deflection means according to FIG. 1. As set forth in greater detail in German Patent 28 38 864, a recording medium AD inked with toner is guided via deflection rollers U1, U2, U3 through a container BH containing a solvent vapor L in a printer means operating on the principle of electrophotography (not shown in detail here) and the toner image is thus fixed on the recording medium AT. The container BH is executed deep and is open only at its upper side OS. The fixing of the toner image on the recording medium AT ensues in its lower region US. The solvent vapor has such a concentration in this region US that the toner image is melted on the recording medium AT and can penetrate into the recording medium. This region is called the fixing region. The solvent vapor is supplied to the fixing region US. In the exemplary embodiment, this ensues in that solvent is introduced into the container BH through a pipe RO. A heating heating means HE, for example a heating coil, can be arranged at the underside SS of the container BH, the solvent being heated by this heating means HE and being converted into its vapor form. A vapor sensor DS that can be constructed in a known way must be provided for measuring the vapor concentration in the fixing region US.

In order to enable the fixing of the toner image on the recording medium AT, the latter must be conducted through the fixing region US together with the toner images. To that end, a lower deflection means—a roller U3 in the exemplary embodiment —is provided in the fixing region of the container BH. The recording medium AT is conducted around this lower fixing means U3 such that the tonered side faces away from the lower deflection means. The recording medium AT is thereby conducted through the container loop-like. It comes from the open, upper side OS of the container BH, proceeds to the lower deflection means U3 and is conducted back to the upper side of the container.

In order to prevent an escape of the solvent vapor from the fixing region US, cooling coils KL are arranged in the container wall above the fixing region US. The solvent vapor that emerges from the fixing region US arrives into a cooled zone where it condenses. In order to promote this process, it is expedient to employ a solvent that is specifically heavier than air in its vapor form. It must be pointed out that the vapor concentration does not suddenly decrease upon transition from the fixing region US to the cooled region; rather, it decreases gradually. However, the vapor concentration is so high only in the fixing region US that a fixing of the toner on the recording medium AT is possible.

With the assistance of an electromotive drive means M, the lower deflection roller U3 can be displaced in the container along the container walls via guide means S that, for example, can be a component part of a cable drive. The actual fixing distance FS in the fixing region US can thus be adjusted.

Given an assumed, constant speed of passage of the recording medium AT through the container BH, the influencing time of the solvent vapor L on the recording medium is varied by varying the fixing distance FS. Different immersion depths of the deflection roller U3 thus result in different influencing times of the solvent vapor L.

Two control circuits are then essentially provided for controlling the fixing quality. A first control circuit controls the vapor concentration in the container BH dependent on the operating conditions. To this end, a sensor for the air pressure SL and a sensor for paper temperature SP are provided, the output signals thereof being acquired by a microprocessor-controlled arithmetic unit RS that is constructed in a standard way. The microprocessor-controlled arithmetic unit RS also additionally acquires an adjustable, manual correction value MK that, for example, can be input via a control keyboard (not shown here). In addition, the arithmetic unit RS is also in communication with the actual apparatus control GS via which, for example, the printer status (print mode, idle mode, etc.) is communicated.

The arithmetic unit calculates the optimum solvent concentration in the container BH for a specific recording medium from all of the values acquired in this fashion. This calculated value serves as rated value for a further difference calculator DF that is likewise constructed in the standard way and that acquires, first, the rated value calculated by the arithmetic unit RS and, second, the actual value supplied by a vapor sensor DS that is converted into a correspondingly adapted signal sequence via a converter W. By forming the difference between the rated value and the actual value, this difference calculator DF calculates the conveyed quantity of solvent required for achieving the optimum concentration of solvent vapor and controls the delivery of this conveyed quantity of solvent via a shut-off valve AS.

The control of the vapor concentration in the ways set forth is notoriously known and, for example, is disclosed in greater detail in German Patent 31 11 970.

The control system for the vapor concentration is then supplemented such that the formation of the difference between rated and actual concentration is evaluated not only for the replenishment quantity of the solvent but is also additionally evaluated for the correction of the new fixing distance FS. Dependent on under-concentration or over-concentration, an adjustment means conducts the lower deflection roller U3 into the position that is pre-programmed therefor. To this end, the deviation of the control circuit calculated by forming the difference between rated and actual value of the vapor concentration is supplied to a further control circuit for the fixing distance FS. This further control circuit contains a microprocessor-controlled arithmetic unit RF for calculating the fixing distance FS whose function is likewise fundamentally monitored by the apparatus control GS and that is constructed in the standard way. From the deviation, the arithmetic unit RF for the fixing distance calculates the correction of the influencing time of the solvent vapor on the recording medium required in order to maintain a constant quality and, thus, calculates the required correction of the fixing distance FS.

In the simplest case according to FIG. 2, the required positioning of the lower deflection roller U3 is carried out by a drive motor M that is connected to the output of a power operational amplifier OV. The control voltage SV applied to the operational amplifier OV prescribes the rated value and is determined by the arithmetic unit for the fixing distance RF via appropriate converters. A path-generating potentiometer WG mechanically coupled to the motor shaft supplies the actual value to the operational amplifier OV. Given an adequately great difference in voltage, the operational amplifier follows the drive motors M up. An analog control ensues in the illustrated exemplary embodiment. As set forth later, however, it is also possible to employ stepping motors that are digitally driven instead of the servo motors.

The additional control circuit for the fixing distance always modifies the length of the paper loop in the vapor region to the ideal operating point. Critical printing mode, for example, briefly intermittent printing mode, high ambient temperatures, operation at high altitude (more than 1500 m above mean sea level) or the employment of special papers can be covered in this way with high quality consistency.

A starting and braking control AB inserted into the control circuit that collaborates with a corresponding digital-to-analog converter DA is intended to secure a soft run-up and stop of the drive motor M for the lower deflection roller U3. The risk that the recording medium AT will rip off due to spontaneous variation of the loop size because a slack in the recording medium or a starting jerk briefly appears is thus prevented. Under certain circumstances, such a sudden operation would result in a distorted imaging of the line to be transferred.

Problems of this type are known from EP-A2-01 15 866 under the designation "smudged printing".

The starting and braking control AB can be a filter acting as a low-pass filter, so that sudden changes are forwarded from the output of the digital-to-analog converter in damped fashion. a soft run-up of the servo motor thereby derives. The soft braking event when the target position is approached automatically derives by decrease of the voltage difference (control voltage/-path-generator voltage) at the inputs of the operational amplifier.

Given employment of a stepping motor as electromotive means M comprising an allocated, digital position transmitter WG according to FIG. 1, it is expedient to control the entire travel distance FW of the deflection roller U3 in program-controlled fashion via a microprocessor CPU. To that end, the optimum acceleration curve BK or, respectively, retardation curve VK (FIG. 3-FIG. 5) is programmed in a memory ROM. The memory cells F1-F8 contain finely graduated digital information that determine the RPMs or, respectively, the stepping frequencies SF, for example F1=1, F8=8.

Upon acceleration BS, the memory cells F1 . . . F8 are successively interrogated with increasing stepping frequencies 1-8 up to the maximum value. This occurs in the inverse sequence during the retardation VS (see FIG. 3). When the travel distance FW is shorter than twice the accelerating distance BS, the incrementation of the memory cells F1-F8 is interrupted at half the travel distance F4 and is again reversed. The highest possible stepping frequency SF is then not reached (see FIG. 4). The maximum stepping frequency SF=8, memory cell F8, is thus only reached when the travel distance FW is at least as long as twice the accelerating distance BS. When the travel distance TW is longer than twice the accelerating distance BS, the maximum stepping frequency (memory cell F8) is retained up to the beginning of the retardation curve VS of equal length (distance of constant speed KS).

The travel distance FW of the deflecting roller U3 that is divided into intervals ΔFW, 1-16 of equal length is thus divided into two respective sub-distances having an interval number ΔFW of the same size. The first distance is the accelerating distance BS; the second distance VS retards the speed again. When, however, the interval number ΔFW, 1-16 is greater than twice the memory cell number F1-F8 or when 1 remains as the remainder of the division, the deflection roller U3 travels at constant speed in this section KS between acceleration curve BS and retardation curve VS (see FIG. 5). STOP thereby references the resting condition of the deflection roller before and after the motion.

I claim:

1. An arrangement for fixing toner images applied to a web-shaped recording medium with a solvent vapor, comprising:

a container containing a solvent vapor in a fixing region;

a guide means for guiding a recording medium into said fixing region in said container, said guide means being arranged displaceable in position within the container;

an electromotive means for varying the position of said guide means in said container to effect a modification of a passage distance of the recording medium through the fixing region of the container;

at least one sensor for sensing an operating condition of the arrangement for fixing; and a control circuit for controlling said electromotive means to modify the passage distance of the recording medium through the fixing region to compensate for variations in the operating conditions sensed by said sensors.

2. An arrangement according to claim 1, wherein the container is open at one side being an upper side, said container including a floor region opposite said upper side and long sides extending therebetween; and wherein the guide means for guiding the recording medium includes a lower guide arranged movable in the container via the electromotive means, being arranged movable parallel to the long sides of said container.

3. An arrangement according to claim 1, wherein said control circuit is a second control circuit, and further comprising a first control circuit that controls a solvent concentration by supplying solvent.

4. An arrangement according to claim 3, wherein the first control circuit forms a deviation signal by forming the difference between an actual signal corresponding to a current solvent concentration and a rated signal calculated taking the operating conditions into consideration, the deviation signal is supplied to the second control circuit, the second control circuit comprises a calculating means that calculates the required modification of the fixing distance and adjusts said electromotive means dependent thereon.

5. An arrangement according to claim 4, further comprising:

a positional transmitter being a distance-generating potentiometer coupled to the electromotive means; and an operational amplifier that adjusts the electromotive means dependent on a control voltage derived from the deviation signal and dependent on an output signal of the positional transmitter.

6. An arrangement according to claim 4, wherein the electromotive means comprises a stepping motor having an allocated, digital position transmitter.

7. An arrangement according to claim 4, further comprising:

a program-controlled arrangement that comprises a memory for the acceptance of acceleration values and of retardation values for the movement of the guide means.

8. A method as claimed in claim 1, wherein said step of automatically adjusting includes:

determining a deviation of an actual vapor concentration from the rated vapor concentration in said fixing region;

determining a correction of a fixing distance of the recording medium through the fixing region depending upon the deviation of the actual vapor concentration from the rated vapor concentration; and controlling an electromotive device to vary said fixing distance of said recording medium in accordance with said correction determined in the preceding step.

* * * * *